US009926784B2

(12) United States Patent
Li et al.

(10) Patent No.: US 9,926,784 B2
(45) Date of Patent: Mar. 27, 2018

(54) FLOAT-SWING HYDRAULIC SUPPORT

(71) Applicant: CHINA UNIVERSITY OF MINING AND TECHNOLOGY, Xuzhou, Jiangsu (CN)

(72) Inventors: Bingwen Li, Jiangsu (CN); Jianyun Hong, Jiangsu (CN); Jun Liu, Jiangsu (CN); Jiyun Zhao, Jiangsu (CN); Shiqi Chen, Jiangsu (CN); Liang Zhao, Jiangsu (CN)

(73) Assignee: CHINA UNIVERSITY OF MINING AND TECHNOLOGY, Jiangsu (CN)

( * ) Notice: Subject to any disclaimer, the term of this patent is extended or adjusted under 35 U.S.C. 154(b) by 69 days.

(21) Appl. No.: 15/031,666

(22) PCT Filed: Nov. 30, 2015

(86) PCT No.: PCT/CN2015/095915
§ 371 (c)(1),
(2) Date: Apr. 22, 2016

(87) PCT Pub. No.: WO2017/071000
PCT Pub. Date: May 4, 2017

(65) Prior Publication Data

US 2017/0260859 A1 Sep. 14, 2017

(30) Foreign Application Priority Data

Oct. 29, 2015 (CN) ..... 2015 1 0725850

(51) Int. Cl.
*E21D 23/04* (2006.01)
*E21D 23/00* (2006.01)

(52) U.S. Cl.
CPC ..... *E21D 23/04* (2013.01); *E21D 23/006* (2013.01); *E21D 23/0008* (2013.01)

(58) Field of Classification Search
CPC ..... E21D 15/44
See application file for complete search history.

(56) References Cited

U.S. PATENT DOCUMENTS 4,132,081 A * 1/1979 Walker ..... E21D 23/0034 405/296
4,266,891 A 5/1981 Plevak et al.
(Continued)

FOREIGN PATENT DOCUMENTS

CN 102704977 * 10/2012
CN 203145981 U 8/2013
(Continued)

*Primary Examiner* — Sean D Andrish
(74) *Attorney, Agent, or Firm* — Christensen, Fonder, Dardi & Herbert PLLC

(57) ABSTRACT

A float-swing hydraulic support, including a top beam, shield beam, elevating frame, base, adjusting jack, two float hydraulic columns, base raising unit, advancing unit, face guard unit, telescopic beam unit, hydraulic control valve block, and a valve block support. The columns are between the top beam and base, with upper ends ball-hinged to the top beam and lower ends ball-hinged to the base; the telescopic beam unit is in the front end of the top beam, and the face guard unit is hinged to the beam unit; the upper end of the shield beam is hinged to the top beam, the lower end is hinged to the upper end of the frame; the upper end of the jack is hinged to the shield beam, the lower end hinged to the base; the ends of the advancing unit are hinged to a scraper conveyor and the base, respectively.

7 Claims, 1 Drawing Sheet

(56) References Cited

U.S. PATENT DOCUMENTS

| | | | | | |
|---|---|---|---|---|---|
| 4,490,076 | A | | 12/1984 | Allen | |
| 4,940,363 | A | * | 7/1990 | Brown | E21D 23/0436 405/291 |
| 5,100,263 | A | * | 3/1992 | Woodford | E21D 23/0436 405/297 |

FOREIGN PATENT DOCUMENTS

| | | | | |
|---|---|---|---|---|
| CN | 104847392 | A | | 8/2015 |
| CN | 105221177 | A | | 1/2016 |
| CN | 205101015 | U | | 3/2016 |
| CN | 205101016 | U | | 3/2016 |
| DE | 20 2008 015 772 | U1 | | 3/2009 |
| DE | 202008015772 | | * | 3/2009 |

* cited by examiner

FLOAT-SWING HYDRAULIC SUPPORT

PRIORITY CLAIM

The present application is a National Phase entry of PCT Application No. PCT/CN2015/095915, filed Nov. 30, 2015, which claims priority to Chinese Patent Application No. 201510725850.2, filed Oct. 29, 2015, the disclosures of which are hereby incorporated by reference herein in their entirety.

FIELD OF THE INVENTION

The present invention relates to a float-swing hydraulic support, which is especially suitable for roof support at underground working faces of fully mechanized coal mining in coal mines, and is also suitable for other occasions where support is required.

BACKGROUND OF THE INVENTION

Mining support facility is one of the most indispensable types equipments in underground areas in coal mines. The support facility used in coal mines mainly includes four-link hydraulic supports, the movement locus of a top beam of which is a lemniscate. Please see the content in Section 3, Chapter 3, Volume 5 of "Mining Support Handbook" published by China Coal Industry Publishing House in 1993 and the content related with support facilities in the textbook "Mining Machinery" planned for academies in "the Eleventh Five-Year Plan", published by China University of Mining and Technology Press in 2010 for details. Four-link hydraulic supports emerged in the 1960s, and were introduced into the coal mining industry in China from the end of the 1970s. However, four-link hydraulic supports have the following drawbacks: 1. the working space and the ventilation area are small, the safety performance and the service performance are poor, and the maintenance and reparation are inconvenient; 2. since the movement locus of its top beam is a lemniscate, one-to-one redesign, trial-manufacturing, and performance test have to be carried out for the hydraulic supports for each use, and the hydraulic supports can be manufactured only after the testing is qualified; consequently, the production efficiency is very low; 3. modular design, standard design, and series design can't be realized for four-link hydraulic supports owing to the structural characteristics of the four-link hydraulic supports; consequently, the design workload is heavy, the production cycle is long, the labor intensity is high, and the production cost is high. In view of the drawbacks of existing four-link hydraulic supports, it is of great practical significance and historic significance to change the technical principle and technical structure of existing hydraulic supports.

SUMMARY OF THE INVENTION

Technical problem: To overcome the drawbacks in the prior art, the present invention provides a float-swing hydraulic support, which has advantages including simple and reliable structure technology, advanced supporting performance, large working space, high safety performance, low production cost, and high service performance.

Technical solution: The float-swing hydraulic support provided in the present invention comprises a top beam, a shield beam, an elevating frame, a base, an adjusting jack, an advancing unit, a scraper conveyor, and a hydraulic control valve block, wherein, the front end of the advancing unit is hinged to the scraper conveyor, and the rear end of the advancing unit is hinged to the base; two float hydraulic columns are arranged in parallel between the front part of the base and the top beam; the upper ends of the two float hydraulic columns are ball-hinged to the top beam, the lower ends of the two float hydraulic columns are ball-hinged to the base, and the rear part of the base is welded with the elevating frame as a whole; a telescopic beam unit is arranged at the front end of the top beam, a face guard unit is hinged to the front end of the telescopic beam unit, the rear end of the top beam is hinged with the shield beam together, and the lower end of the shield beam is hinged with the upper end of the elevating frame together; the upper end of the adjusting jack is hinged to the shield beam, and the lower end of the adjusting jack is hinged to the base; the top beam swings up and down around the hinge shaft between it and the shield beam under the action of the two float hydraulic columns; the shield beam swings up and down around the hinge shaft between it and the elevating frame under the action of the adjusting jack; front and rear bridge pieces are arranged on the base, a base raising unit is arranged on the front bridge piece, and a valve block support for the hydraulic valve block is mounted on the rear bridge piece.

The hydraulic control valve block is a manually operated hydraulic valve block or electro-hydraulically remotely-controlled valve block.

The face guard unit is a first-grade face guard unit, or a second-grade face guard unit, or a zero-grade face guard unit.

The advancing unit is a direct-push advancing unit or a back-pull advancing unit.

The adjusting jack comprises one jack bar used separately or two jack bars used in parallel.

The upper ends of the two float hydraulic columns are ball-hinged to the top beam, and the lower ends of the columns are ball-hinged to the base.

A diagonal bracing comprising one bracing bar used separately or two bracing bars used in parallel is arranged between the upper part of the elevating frame and the base.

Beneficial effects: The key techniques employed in the float-swing hydraulic support provided in the present invention are a floating hydraulic technique and secondary rocker technique, wherein, the columns of the support are float hydraulic columns, which are resistant to rock bursts and thereby improve the safety and stability of the support, the basic structure of the support employs a secondary rocker technique, in which the secondary rocker enables the top beam to swing along an arc line when the primary rocker moves upwards to the roof; since the primary rocker has come into contact with the roof, the secondary rocker can enable the top beam to swing within a small range; hence, the relative displacement distance between the top beam of the support and the roof is very small, the roof support and surrounding rock control is safe and efficient. The float-swing hydraulic support realizes modular design, standard design, and series design; the hydraulic support in maximum height can cover the hydraulic support in smaller height in the module; thus, intermediate links are reduced, the production efficiency is improved, the production cost is decreased, and the hydraulic support is suitable for rapid promotion. Several modules can be arranged according to the roof pressure and height in a coal mine, and several hydraulic support standards that have the same working resistance but different height can be designed for each module, and the height standards meet the criterion for serialization; based on a principle that the support in maximum height covers the support in smaller height, a prototype support in maximum height can be trial-manufactured, tested, and certified, while the support in smaller height is covered by the support in maximum height; thus, intermediate production links can be reduced, and the production cycle can be shortened. The major advantages include:

(1) The float-swing hydraulic support provided in the present invention realizes modular design, standard design, and series design; specifically, the components can be made into standard components, supports in different heights can be assembled in standard series according to the actual conditions of the coal seam, and the specific standard of the support can be selected as required; thus, the production efficiency can be improved;

(2) The float-swing hydraulic support provided in the present invention supports mass production; specifically, the components can be produced on separate production lines, so that quick and effective large-scale production can be realized, to attain a purpose of large-scale and extensive application of the hydraulic support in coal mines;

(3) The float-swing hydraulic support provided in the present invention provides large working space and large ventilation area, is suitable for use in coal mines with gas outburst risk, is easy, safe and convenient to use, and has high stability and wide practicability.

(4) The float-swing hydraulic support provided in the present invention employs a secondary rocker technique; specifically, the secondary rocker enables the top beam to contact with the roof quickly, smoothly and steadily after the primary rocker comes into contact with the roof; in addition, compared with conventional hydraulic supports, in the float-swing hydraulic support provided in the present invention, the relative displacement distance between the top beam and the roof is greatly reduced; therefore, the safety of roof support and surrounding rock control is enhanced.

In the figures: 1—top beam; 2—shield beam; 3—elevating frame; 4—base; 5—adjusting jack; 6—float hydraulic columns; 7—base raising unit; 8—advancing unit; 9—scraper conveyor; 10—face guard unit; 11—telescopic beam unit; 12—hydraulic control valve block; 13—valve block support; 14—front bridge piece; 15—rear bridge piece; 16—diagonal bracing; 17—hinge shaft, 18—hinge shaft.

DETAILED DESCRIPTION

Hereunder the present invention will be further described according to the examples shown in the accompanying drawings:

Example 1

Figure 1:
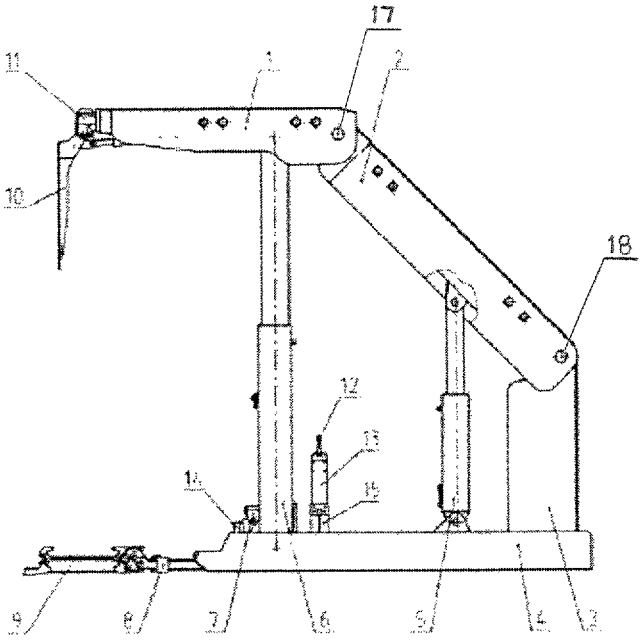
FIG. 1 is a schematic structural diagram of example 1 of the present invention.

As shown in FIG. 1, the float-swing hydraulic support provided in the present invention mainly comprises a top beam 1, a shield beam 2, an elevating frame 3, a base 4, an adjusting jack 5, two float hydraulic columns 6, a base raising unit 7, an advancing unit 8, a scraper conveyor 9, a face guard unit 10, a telescopic beam unit 11, a hydraulic control valve block 12, a valve block support 13, a front bridge piece 14, and a rear bridge piece 15. The top beam 1, shield beam 2, elevating frame 3, and base 4 are made of steel plate or profile steel by welding. The front bridge piece 14 and the rear bridge pieces 15 are made of thick steel plates by welding, and are welded with the base 4 as a whole. The hydraulic control valve block 12 is a manually operated valve block or electro-hydraulically remotely-controlled valve block, serves as a manipulation center of the actions of the support, and can be manually operated or electro-hydraulically remotely-controlled. The front end of the advancing unit 8 is hinged to the scraper conveyor 9, and the rear end of the advancing unit 8 is hinged to the base 4; the advancing unit 8 is a direct-push advancing unit or a back-pull advancing unit. The two float hydraulic columns 6 are arranged in parallel between the front part of the base 4 and the top beam 1, the upper ends of the two float hydraulic columns 6 are ball-hinged to the top beam 1, and the lower ends of the two float hydraulic columns 6 are ball-hinged to the base 4. The rear part of the base 4 is welded with the elevating frame 3 as a whole; the telescopic beam unit 11 is disposed in the front end of the top beam 1, and the face guard unit 10 is hinged to the front end of the telescopic beam unit 11; the face guard unit 10 is a first-grade face guard unit, or a second-grade face guard unit, or a zero-grade face guard unit; the face guard unit is composed of face guards, face guard jack supporting the face guards, and hinge shafts. The rear end of the top beam 1 is hinged with the shield beam 2 together, and the lower end of the shield beam 2 is hinged with the upper end of the elevating frame 3 together; the upper end of the adjusting jack 5 is hinged to the shield beam 2, and the lower end of the adjusting jack 5 is hinged to the base 4; the adjusting jack 5 comprises one jack bar used separately or two jack bars used in parallel. The top beam 1 swings up and down around the hinge shaft between it and the shield beam 2 under the action of the two float hydraulic columns 6; the shield beam 2 swings up and down around the hinge shaft between it and the elevating frame 3 under the action of the adjusting jack 5; the front and rear bridge pieces are arranged on the base 4, the base raising unit 7 is arranged on the front bridge piece 14, and the valve block support 13 provided with hydraulic valve block 12 is mounted on the rear bridge piece 15.

The advancing unit 8 is disposed in the base 4, with two ends being respectively hinged to the base 4 and the scraper conveyor 9 in the coal mining working face; the advancing unit 8 is a component configured to push the scraper conveyor 9 and move the hydraulic support. When the two float hydraulic columns 6 extend and retract up and down, the top beam 1 swings up and down around the hinge shaft 17 between the top beam 1 and the shield beam 2; when the adjusting jack 5 extends and retracts up and down, the shield beam 2 swings up and down around the hinge shaft 18 between the shield beam 2 and the elevating frame 3.

The hydraulic control valve block 12 serves as a manipulation center for the manipulation and control of float-swing hydraulic support, i.e., the two float hydraulic columns 6, telescopic beam unit 11, face guard unit 10, advancing unit 8, base raising unit 7, and adjusting jack 5 of the support are manipulated and controlled via the hydraulic control valve block 12; the hydraulic control valve block 12 is mounted on the rear bridge piece 15 via the valve block support 13.

Example 2

Figure 2:
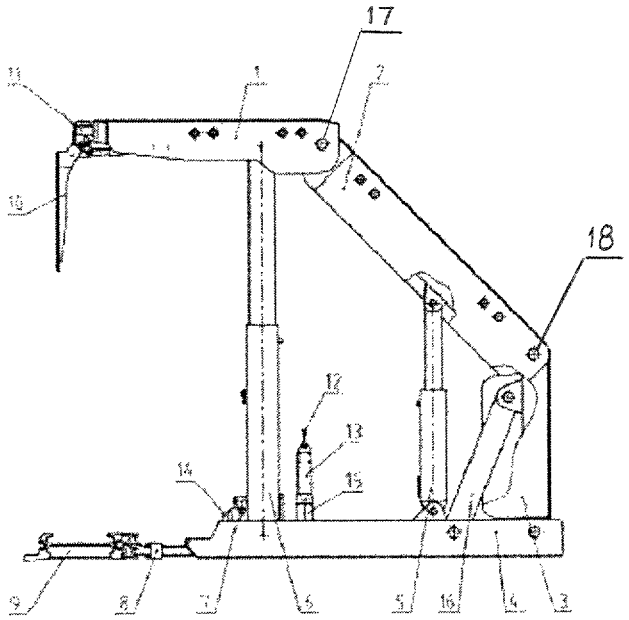
FIG. 2 is a schematic structural diagram of example 2 of the present invention.

As shown in FIG. 2, example 2 is essentially the same as the example 1. Herein, the description of identical parts is omitted. The difference lies in: a diagonal bracing 16 comprising one bracing bar used separately or two bracing bars used in parallel is arranged between the upper part of the elevating frame 3 and the base 4.

Working Process:

To raise the support, the hydraulic control valve block 12 is operated, so that a high-pressure liquid enters into a big chamber of the two float hydraulic columns 6 and the adjusting rack 5, and the top beam 1 and the shield beam 2 swing and move upward; the shield beam 2 stops moving upward when it comes into contact with the roof, while the top beam 1 further swing slightly around the hinge shaft between the top beam 1 and the shield beam 2 under the action of the two float hydraulic columns 6, till the initial support resistance of the support is reached; the telescopic beam unit 11 and the face guard unit 10 extend or unfold accordingly, and the shield beam 2 rotates around the hinge shaft between it and the elevating frame 3 during the rising process.

To lower the support, the hydraulic control valve block 12 is operated, so that the high-pressure liquid enters into a small chamber of the two float hydraulic columns 6 and the adjusting jack 5, the top beam 1 and the shield beam 2 swing and move downward, the telescopic beam unit 11 and the face guard unit 10 retract accordingly, the top beam 1 rotates around the hinge shaft between it and the shield beam 2 and descends at the same time, while the shield beam 2 swings around the hinge shaft between it and the elevating frame 3 and descends at the same time; thus, the top beam 1 and the shield beam 2 swing in relation to each other around their hinge shafts at the same time and thereby the support is lowered.

To push the scraper conveyor 9 forward, the hydraulic control valve block 12 is operated, so that the high-pressure liquid enters into a small chamber or a big chamber of the jack in the advancing unit 8, and thereby the scraper conveyor 9 is pushed forward.

To advance the hydraulic support, the scraper conveyor 9 is fixed, and the hydraulic control valve block 12 is operated, so that the high-pressure liquid enters into a small chamber or a big chamber of the jack in the advancing unit 8, and thereby the hydraulic support is pulled forward.

All of the four actions of the support are accomplished by operating the hydraulic control valve block 12, and the sequence of actions of the support is determined according to the field situation at the working face; a working cycle of the support is accomplished whenever a cycle of support raising, support lowering, conveyor pushing, and support advancing actions is completed.

The invention claimed is:

1. A float-swing hydraulic support, comprising a top beam, a shield beam, an elevating frame, a base, an adjusting jack, an advancing unit, and a hydraulic control valve block, wherein:

a rear end of the advancing unit is hinged to the base;

two float hydraulic columns are arranged in parallel between a front part of the base and the top beam;

upper ends of the two float hydraulic columns are ball-hinged to the top beam, lower ends of the two float hydraulic columns are ball-hinged to the base, and a rear part of the base is welded with the elevating frame as a whole;

a telescopic beam unit is arranged at a front end of the top beam, a face guard unit is hinged to a front end of the telescopic beam unit, a rear end of the top beam is hinged with the shield beam, and a lower end of the shield beam is hinged directly to an upper end of the elevating frame;

an upper end of the adjusting jack is hinged to the shield beam, and a lower end of the adjusting jack is hinged to the base;

the top beam swings up and down around a hinge shaft between the top beam and the shield beam under the action of the two float hydraulic columns;

the shield beam swings up and down around a hinge shaft between the shield beam and the elevating frame under the action of the adjusting jack;

a front bridge piece and a rear bridge piece are arranged on the base, a base raising unit is arranged on the front bridge piece, and a valve block support provided with the hydraulic valve block is mounted on the rear bridge piece.

2. The float-swing hydraulic support according to claim 1, wherein: the hydraulic control valve block is a manually operated hydraulic valve block or electro-hydraulically remotely-controlled valve block.

3. The float-swing hydraulic support according to claim 1, wherein: the face guard unit is a first-grade face guard unit, or a second-grade face guard unit, or a zero-grade face guard unit.

4. The float-swing hydraulic support according to claim 1, wherein: the advancing unit is a direct-push advancing unit or a back-pull advancing unit.

5. The float-swing hydraulic support according to claim 1, wherein: the adjusting jack comprises one jack bar used separately or two jack bars used in parallel.

6. The float-swing hydraulic support according to claim 1, wherein: a diagonal bracing comprising one bracing bar used separately or two bracing bars used in parallel is arranged between an upper part of the elevating frame and the base.

7. The float-swing hydraulic support according to claim 1, wherein a front end of the advancing unit is hinged for coupling with a scraper conveyor.

* * * * *